US009627834B2

(12) United States Patent
Cheng et al.

(10) Patent No.: US 9,627,834 B2
(45) Date of Patent: Apr. 18, 2017

(54) ELECTRICAL CONNECTOR WITH IMPROVED FIXING STRUCTURE

(71) Applicant: FOXCONN INTERCONNECT TECHNOLOGY LIMITED, Grand Cayman (KY)

(72) Inventors: Wei-Wei Cheng, Kunshan (CN); Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/987,786

(22) Filed: Jan. 5, 2016

(65) Prior Publication Data

US 2016/0197422 A1 Jul. 7, 2016

(30) Foreign Application Priority Data

Jan. 5, 2015 (CN) ..... 2015 1 0002226

(51) Int. Cl.

| | |
|---|---|
| ***H01R 43/20*** | (2006.01) |
| ***H01R 12/72*** | (2011.01) |
| ***H01R 13/639*** | (2006.01) |
| ***H01R 13/66*** | (2006.01) |

(52) U.S. Cl.
CPC ..... *H01R 43/205* (2013.01); *H01R 12/721* (2013.01); *H01R 13/639* (2013.01); *H01R 13/6658* (2013.01)

(58) Field of Classification Search
USPC ..... 439/78, 74, 82, 482, 499, 157, 327
See application file for complete search history.

(56) References Cited

U.S. PATENT DOCUMENTS

| | | | | |
|---|---|---|---|---|
| 7,233,500 | B2 * | 6/2007 | Yu | H05K 7/1409 361/679.32 |
| 7,500,863 | B2 * | 3/2009 | Ringler | H01R 13/6275 439/159 |
| 7,758,374 | B2 * | 7/2010 | Yu | H01R 4/027 439/493 |
| 7,955,098 | B1 * | 6/2011 | McKee | H01R 12/721 439/157 |
| 8,133,071 | B2 * | 3/2012 | Huang | H01R 12/778 439/499 |
| 9,077,101 | B2 * | 7/2015 | Wu | H01R 12/53 |
| 2010/0190373 | A1 * | 7/2010 | Yeh | H01R 12/774 439/499 |

* cited by examiner

*Primary Examiner* — Alexander Gilman
(74) *Attorney, Agent, or Firm* — Wei Te Chung; Ming Chieh Chang

(57) ABSTRACT

An electrical connector including an insulative housing; a number of contacts retained in the insulative housing; a printed circuit board electrically connected with the contacts; and a fixing member assembled to both the insulative housing and the printed circuit board, the fixing member having a pair of latch arms extending from two opposite sides thereof to hold two sides of the printed circuit board.

19 Claims, 5 Drawing Sheets

ELECTRICAL CONNECTOR WITH IMPROVED FIXING STRUCTURE

BACKGROUND OF THE INVENTION

1. Field of the Invention

The present invention relates to an electrical connector, and more particularly to an electrical connector assembly having a fixing structure for an internal printed circuit board thereof.

2. Description of Related Art

U.S. Pat. No. 7,758,374 issued on Jul. 20, 2010 discloses a cable connector assembly comprising an insulative housing, a number of contacts retrained in the insulative housing, and a printed circuit board (PCB) assembled on a rear end of the insulative housing. The contacts are arranged on two opposite sides of the PCB and soldered on corresponding conductive pads of the PCB. The PCB is not positively retained to the insulative housing such that the PCB is apt to move by an external force.

Hence, an electrical connector assembly with improved fixing structure of an internal printed circuit board thereof is desired.

BRIEF SUMMARY OF THE INVENTION

According to one aspect of the present invention, an electrical connector comprises: an insulative housing; a number of contacts retained in the insulative housing; a printed circuit board electrically connected with the contacts; and a fixing member assembled to both the insulative housing and the printed circuit board, the fixing member having a pair of latch arms extending from two opposite sides thereof to hold two sides of the printed circuit board.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
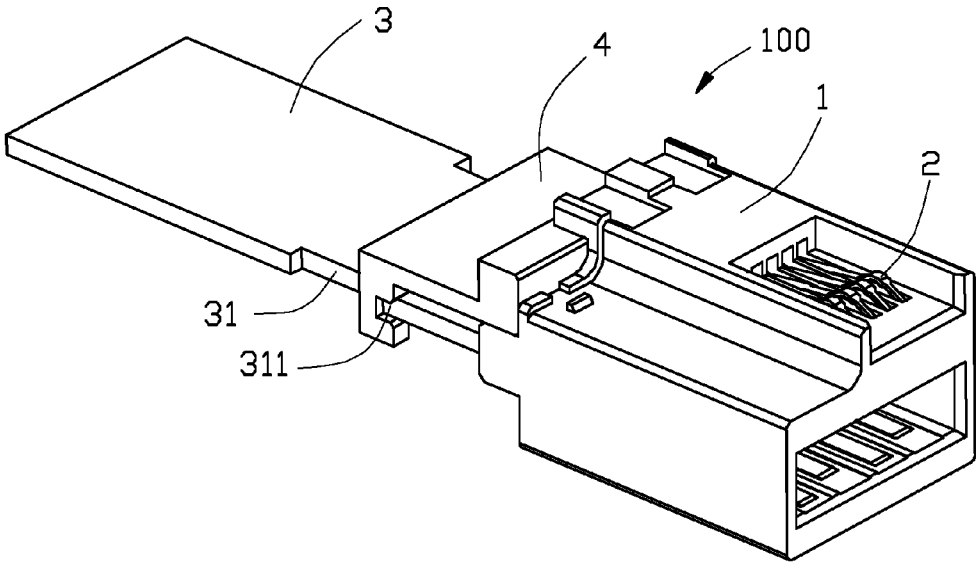
FIG. 1 is a perspective assembled view of an electrical connector according to the present invention.
Figure 2:
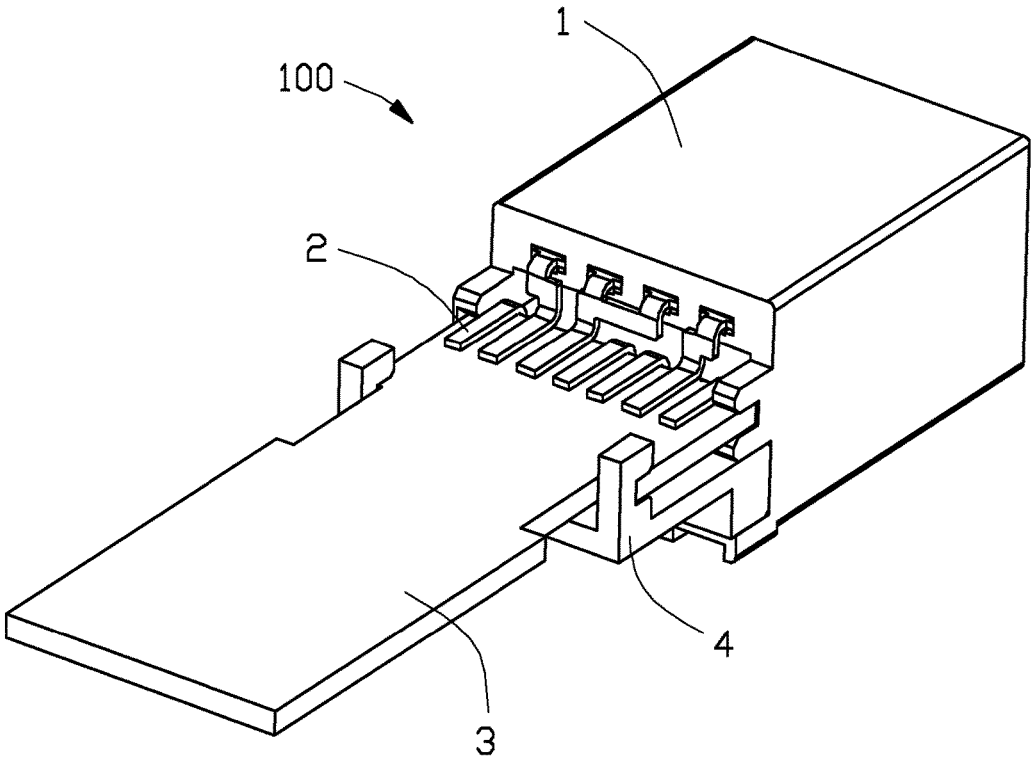
FIG. 2 is a view similar to the FIG. 1 but from a different perspective.
Figure 3:
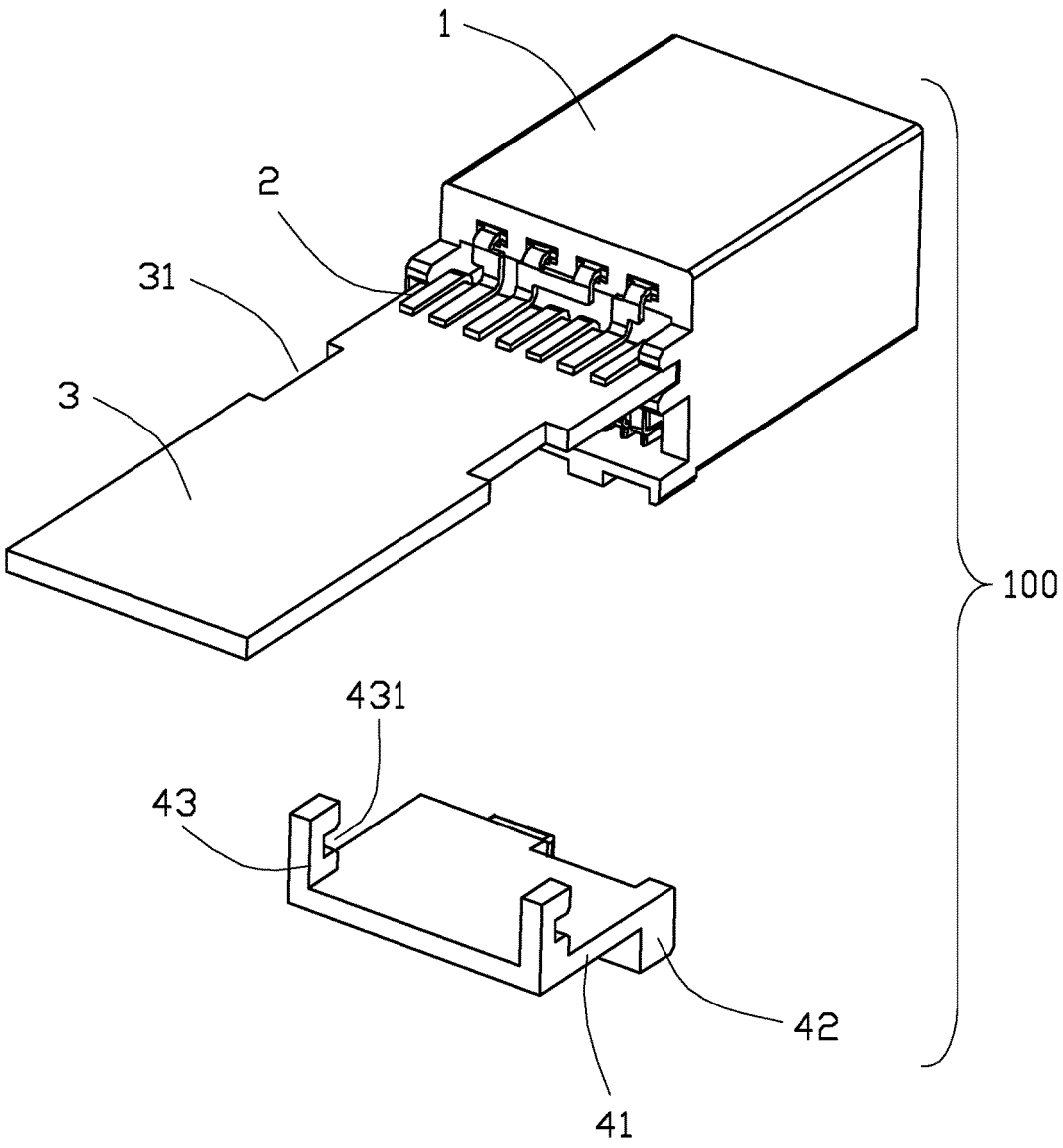
FIG. 3 is a partly exploded view of the electrical connector in FIG. 2.
Figure 4:
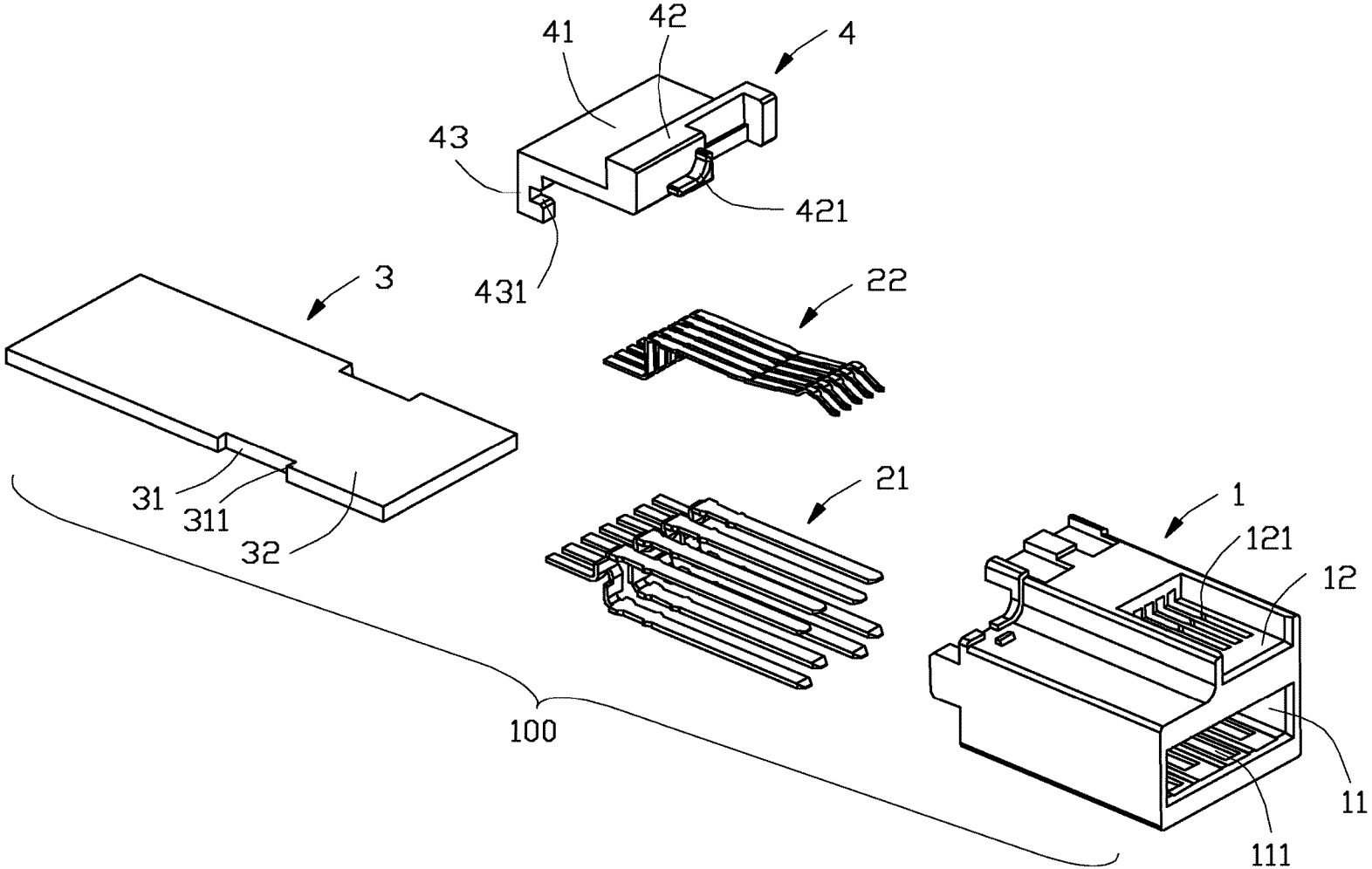
FIG. 4 is a further exploded view of the electrical connector in FIG. 3.
Figure 5:
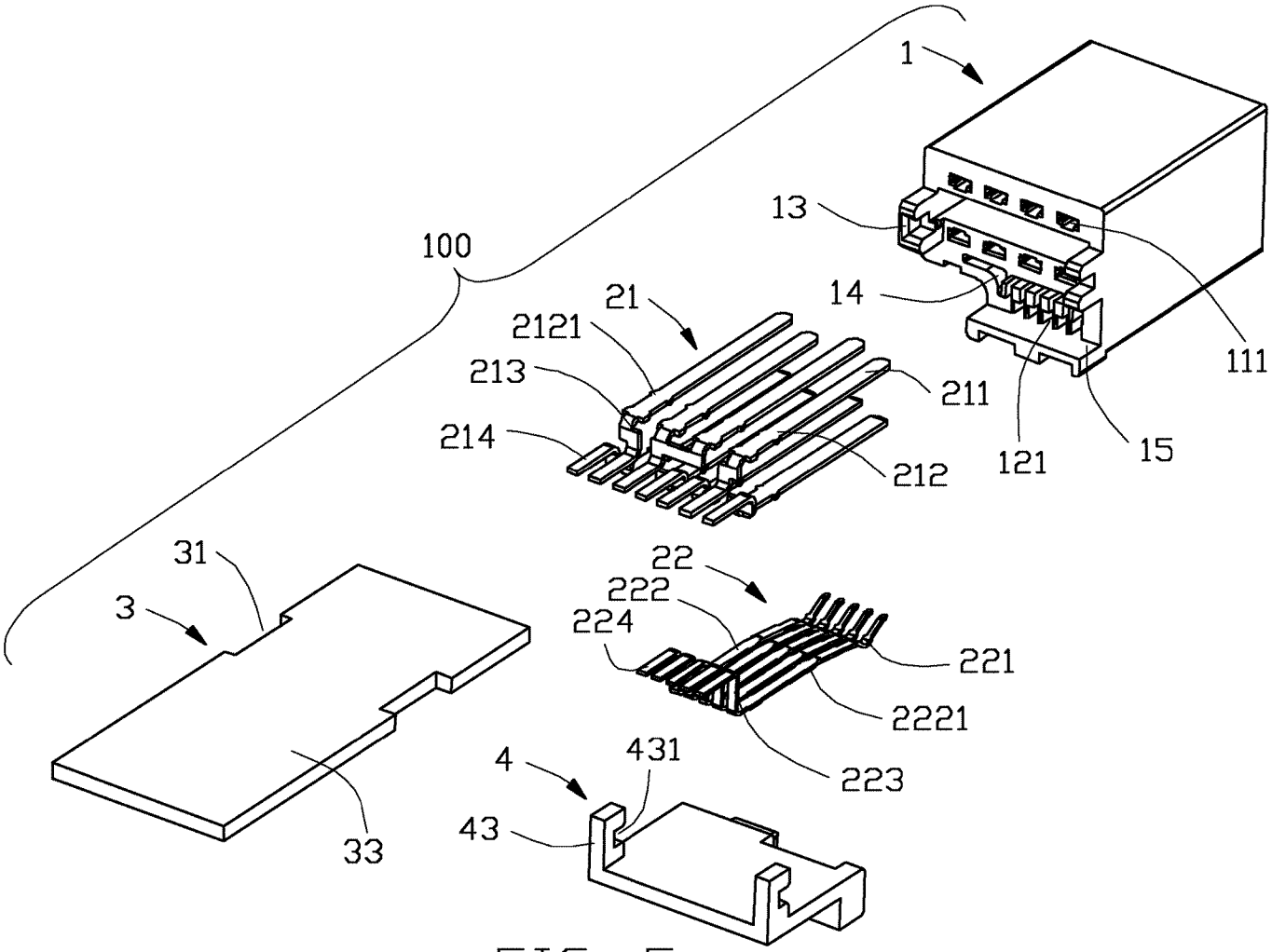
FIG. 5 is a view similar to FIG. 4 but from a different perspective.

Referring to FIGS. 1-5, an electrical connector 100 according to a preferred embodiment of the present invention includes an insulative housing 1, a plurality of contacts 2, a printed circuit board 3 electrically connected with the contacts 2, and a fixing member 4 assembled between the insulative housing 1 and the printed circuit board 3.

The insulative housing 1 includes a first inserting room 11 and a second inserting room 12 extending therethrough along an inserting direction of a mating connector. The second inserting room 12 is defined through the insulative housing 1 and overlaying with the first inserting room 11 along a vertical direction perpendicular to the inserting direction. The second inserting room 12 is arranged on a side of the top of the first inserting room 11. A number of first receiving slots 111 are defined on the top and bottom side of the first inserting room 11 symmetrically. A plurality of second receiving slots 121 are defined on a bottom side of the second inserting room 12. A pair of latches 13 extend rearwardly from two opposite sides of the insulative housing 1. A groove 14 is defined between the pair of latches 13 on the insulative housing 1, extending along a rear-to-front direction. A gap 15 is defined on a rear end of the insulative housing 1 proximate to the second receiving slots 121.

The contacts 12 include a plurality of first contacts 21 received in the corresponding first receiving slots 111 of the first inserting room 11 and a plurality of second contacts 22 received into the corresponding second receiving slots 121 of the second inserting room 12. The first contacts 21 are arranged in a top and bottom rows of the first receiving slots 111, respectively. Each of the first contacts 21 includes a first fixing portion 212 retained in the insulative housing 1, a first contacting portion 211 forwardly extending from a front end of the first fixing portion 212 to the first inserting room 11, a first bent portion 213 rearwardly extending from a rear end of the first fixing portion 212 perpendicularly relative to the first fixing portion 212, and a first tail portion 214 extending from a rear end of the first bent portion 213 along the inserting direction. The first tail portions 214 are arranged on a same plane as the first contacting portions 211 are located. A first holding portion 2121 extends from each of the opposite sides of the first fixing portions 212.

Each of the second contacts 22 includes a second fixing portion 222 retained in the insulative housing 1, a second contacting portion 221 forwardly extending from a front end of the second fixing portion 222 into the second inserting room 12, a second bent portion 223 extending vertically from a rear end of the second fixing portion 222 to the first contacts 21 direction, and a second tail portion 224 rearwardly extending from a rear end of the second bent portion 223 along the inserting direction. A second holding portion 2221 extends from each of the opposite sides of the second fixing portions 222. The second tail portions 224 are arranged parallel to the first tail portions 214 along the vertical direction.

The printed circuit board 3 is substantially rectangular and defines a slots 31 on each of the opposite sides thereof. The printed circuit board 3 includes a top surface 32 and a bottom surface 33. A front end of the printed circuit board 3 has a plurality of conductive pads (not shown) on both the top and bottom surfaces 32 and 33. The printed circuit board 3 is assembled on the insulative housing 1 from a rear-to-front direction, received between the pair of latches 13 of the insulative housing 1. The first tail portions 214 of the first contacts 21 bear against the conductive pads on the bottom surface 33 of the printed circuit board 3, and the second tail portions 224 of the second contacts 22 bear down against the conductive pads on the top surface 32 of the printed circuit board 3, thus the printed circuit board 3 is held between the first and second tail portions 214 and 224.

The fixing member 4 includes a base portion 41 extending along a horizontal plane, a mounting portion 42 upwardly extending from a front end of the base portion 41, and a pair of latch arms 43 downwardly extending from two opposite sides of a rear end of the base portion 41. The mounting portion 42 forwardly extends to form a projection portion 421 to be received in the groove 14 of the insulative housing 1. The mounting portion 42 bears against the rear end of the insulative housing 1 and engages with the gap 15. The latch arms 43 are received in the corresponding slot 31 of the printed circuit board 3. Each of the latch arms 43 defines a fixing slot 431 on a central portion thereof from a front sidewall along a front-to-rear direction. The latch arms 43 of the fixing member 4 bear against two opposite sides of the slots 31, respectively. The portions of the printed circuit board 3 near a front end of the slots are received in the corresponding fixing slots 431 of the latch arms 43 along the rear-to-front direction, to limit movement along the vertical direction of the printed circuit board 3.

When the electrical connector 100 is assembled, the first and second contacts 21 and 22 are mounted in the corresponding first receiving slots 111 and second receiving slots 121 firstly. The printed circuit board 3 is assembled on a rear end of the insulative housing 1 along the rear-to-front direction, and the first and second tail portions 214 and 224 are soldered with the corresponding conductive pads of the printed circuit board 3. The fixing member 4 is placed on the printed circuit board 3 along a top-to-down direction, to make the latch arms 43 be received in the corresponding slots 31. The portions of the printed circuit board 3 near the front end of the slots 31 are received in the corresponding fixing slots 431 by moving the fixing member 4 along the rear-to-front direction, and the mounting portion 42 of the fixing member 4 is received in the gap 15 to bear against the rear end of the insulative housing 1 at the same time. Understandably, an additional resilient hook may be provided on either the housing 1 or the fixing member 4 for securing/engagement therebetween when the fixing member 4 reaches its final locking position.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing;

a plurality of contacts retained in the insulative housing;

a printed circuit board electrically connected with the contacts; and a fixing member assembled to both the insulative housing and the printed circuit board, the fixing member having a pair of latch arms extending from two opposite sides thereof to hold two sides of the printed circuit board; wherein the fixing member includes a base portion and a mounting portion extending from a front end of the base portion, and the latch arms extend from two opposite sides of a rear end of the base portion, respectively; and the configuration of the mounting portion, the base portion, and the latch arms is substantially Z-shaped.

2. The electrical connector according to claim 1, wherein the printed circuit board defines a slot on each of the two opposite sides, and each of the latch arms has a fixing slot engaging the printed circuit board.

3. The electrical connector according to claim 1, wherein the mounting portion of the fixing member forwardly extends to form a projection portion, the insulative housing defines a groove on a rear end thereof, and the projection portion is received in the groove to assemble the fixing member on the insulative housing.

4. The electrical connector according to claim 1, wherein the insulative housing extends to form a pair of latches on two opposite sides of a rear end of the insulative housing, and the printed circuit board is held between the latches.

5. The electrical connector according to the claim 1, wherein the insulative housing defines a first inserting room and a second inserting room arranged overlaying with each other along a vertical direction, the second inserting room is arranged on a side of the top of the first inserting room.

6. The electrical connector according to claim 5, wherein:

the first inserting room defines a plurality of first receiving slots;

the contacts include a plurality of first contacts received in corresponding first receiving slots;

each of the first contacts includes a first fixing portion, a first contacting portion forwardly extending from a front end of the first fixing portion into the first receiving slots, a first bent portion rearwardly extending from a rear end of the first fixing portion, and a first tail portion rearwardly extending from a rear end of the first bent portion along a horizontal direction; and the first tail portions of the first contacts is arranged in a same plane.

7. The electrical connector according to claim 6, wherein:

the second inserting room defines a plurality of second receiving slots;

the contacts include a plurality of second contacts received in corresponding second receiving slots;

each of the second contacts includes a second fixing portion, a second contacting portion forwardly extending from a front end of the second fixing portion into the second receiving slots, a second bent portion extending from a rear end of the second fixing portion along a direction toward the first contacts, and a second tail portion rearwardly extending from a rear end of the second bent portion along the horizontal direction; and the second tail portions are arranged parallel to the first tail portions along the vertical direction.

8. The electrical connector according to claim 7, wherein the insulative housing defines a gap on a rear portion thereof, and the mounting portion of the fixing member engages with the gap from a rear-to-front direction.

9. An electrical connector comprising:

an insulative housing;

a plurality of contacts retained in the insulative housing;

a printed circuit board electrically connected with the contacts; and a fixing member assembled to both the insulative housing and the printed circuit board, the fixing member having a pair of latch arms extending from two opposite sides thereof to hold two sides of the printed circuit board;

wherein the insulative housing defines a first inserting room and a second inserting room arranged overlaying with each other along a vertical direction, the second inserting room is arranged on a side of the top of the first inserting room;

wherein the first inserting room defines a plurality of first receiving slots; the contacts include a plurality of first contacts received in corresponding first receiving slots; each of the first contacts includes a first fixing portion, a first contacting portion forwardly extending from a front end of the first fixing portion into the first receiving slots, a first bent portion rearwardly extending from a rear end of the first fixing portion, and a first tail portion rearwardly extending from a rear end of the first bent portion along a horizontal direction; and the first tail portions of the first contacts is arranged in a same plane; and wherein the second inserting room defines a plurality of second receiving slots; the contacts include a plurality of second contacts received in corresponding second receiving slots; each of the second contacts includes a second fixing portion, a second contacting portion forwardly extending from a front end of the second fixing portion into the second receiving slots, a second bent portion extending from a rear end of the second fixing portion along a direction toward the first contacts, and a second tail portion rearwardly extending from a rear end of the second bent portion along the horizontal direction; and the second tail portions are arranged parallel to the first tail portions along the vertical direction.

10. The electrical connector according to claim 9, wherein the printed circuit board defines a slot on each of the two opposite sides, and each of the latch arms has a fixing slot engaging the printed circuit board.

11. The electrical connector according to claim 9, wherein the fixing member includes a base portion and a mounting portion extending from a front end of the base portion, and the latch arms extend from two opposite sides of a rear end of the base portion, respectively.

12. The electrical connector according to claim 11, wherein the mounting portion of the fixing member forwardly extends to form a projection portion, the insulative housing defines a groove on a rear end thereof, and the projection portion is received in the groove to assemble the fixing member on the insulative housing.

13. The electrical connector according to claim 9, wherein the insulative housing extends to form a pair of latches on two opposite sides of a rear end of the insulative housing, and the printed circuit board is held between the latches.

14. The electrical connector according to claim 9, wherein the insulative housing defines a gap on a rear portion thereof, and the mounting portion of the fixing member engages with the gap from a rear-to-front direction.

15. An electrical connector comprising:

an insulative housing defining a plurality of passageways arranged with one another along a transverse direction, each of said passageways extending along a front-to-back direction perpendicular to said transverse direction;

a plurality of contacts disposed in the corresponding passageways, respectively;

a horizontal printed circuit board retained to a rear side of the housing, on which tails of the contacts are soldered; and a fixing member discrete from and positioned upon the rear side of the housing and located by one side of the printed circuit board in a vertical direction perpendicular to both said front-to-back direction and said transverse direction; wherein said fixing member includes not only a locking structure forwardly abutting against the printed circuit board to prevent backward movement of the printed circuit board but also a wall structure to veil backsides of the corresponding passageways so as to assure true position of the printed circuit board and no contamination in the passageways during applying molding upon the printed circuit board and the housing; wherein said housing forms a gap which is open rearwardly to receive a front portion of the fixing member therein after the fixing member is forwardly assembled to the housing so as to retain the fixing member in position with regard to the housing in at least the vertical direction and the front-to-back direction.

16. The electrical connector as claimed in claim 15, wherein the locking structure further retains the printed circuit board in position in the vertical direction.

17. The electrical connector as claimed in claim 15, wherein the printed circuit board forms a pair of lateral slots, and said locking structure is configured to be smaller enough to initially be inserted into the corresponding lateral slot in the vertical direction and successively forwardly moved to lock the printed circuit board in position.

18. The electrical connector as claimed in claim 15, wherein said fixing member forms a forwardly open fixing slot with a vertical dimension similar to a thickness of the printed circuit board so as to snugly receive the printed circuit board therein around the corresponding lateral slot.

19. The electrical connector as claimed in claim 15, wherein the housing forms a groove in the rear side to receive a front end of the printed circuit board, and the printed circuit board forms behind the front end a pair of lateral slots where the locking structure is located.

* * * * *